United States Patent [19]

Stollberg

[11] 4,304,353

[45] Dec. 8, 1981

[54] CONTAINER WITH LATCHING STRUCTURE

[75] Inventor: Ray H. Stollberg, Gilroy, Calif.

[73] Assignee: Crown Zellerbach Corporation, San Francisco, Calif.

[21] Appl. No.: 159,907

[22] Filed: Jun. 16, 1980

[51] Int. Cl.[3] ..... B65D 5/22; B65D 43/10; B65D 45/00

[52] U.S. Cl. ..... 229/33; 229/44 R; 229/45 R; 229/DIG. 11

[58] Field of Search ..... 229/44 R, 45, 23, DIG. 11, 229/36, 33

[56] References Cited

U.S. PATENT DOCUMENTS

| | | | |
|---|---|---|---|
| 2,619,276 | 11/1952 | Gibbons | 229/33 |
| 2,721,689 | 10/1955 | Nye | 229/DIG. 11 |
| 2,807,407 | 9/1957 | Van Rosen | 229/45 X |
| 3,539,090 | 11/1970 | Blasdell | 229/38 |
| 3,713,579 | 1/1973 | Chaffers | 229/44 R |
| 4,134,533 | 1/1979 | Heavner | 229/DIG. 11 |
| 4,142,665 | 3/1979 | Jewell | 229/34 R X |
| 4,175,691 | 11/1979 | Cornell et al. | 229/36 |
| 4,245,773 | 1/1981 | Stollberg | 229/DIG. 11 |

*Primary Examiner*—Herbert F. Ross
*Attorney, Agent, or Firm*—Thomas R. Lampe

[57] ABSTRACT

A container of corrugated paperboard or the like comprising the combination of a box body having a bottom wall and interconnecting side walls and resilient wedge-shaped latch means attached to the box body and positionable in the aperture of a cover when the cover is positioned over the interior of the box body whereby the cover is retained by the latch means.

5 Claims, 8 Drawing Figures

CONTAINER WITH LATCHING STRUCTURE

BACKGROUND AND OBJECTS OF THE INVENTION

The packing and shipping of produce such as grapes, tomatoes, cherries, etc. calls for the usage of specialized boxes of sturdy construction that are readily assembled and stacked. In addition, it is desirable to incorporate latch means on containers of this type to maintain the integrity of the box, especially during shipping.

A wide variety of containers have been devised for this purpose including those containers disclosed in U.S. Pat. No. 3,713,579, issued Jan. 30, 1973 to John W. Chaffers, and applicant's co-pending application U.S. Ser. No. 068,781 filed Aug. 22, 1979, now U.S. Pat. No. 4,245,773.

The container of the present invention is of the general type disclosed in the aforesaid patent and application; however, the container disclosed herein incorporates a new latching structure that is characterized by its simplicity and contribution to the improved functioning of the container. Specifically, the container disclosed herein is characterized by its ease of closure and integrity after closing due to the positive locking force exerted by the latch means employed therein. In addition, the latch means of the present invention is characterized by its improved strength characteristics, thus making it particularly useful as stacking alignment structure, and by its moisture resistance.

SUMMARY OF THE INVENTION

According to the present invention, a container particularly useful for the packing and shipping of produce and similar material is provided which is of simple and economical construction and yet has certain characteristics desirable in such a container. In particular, the container is of unitary construction and includes a box body, a cover for the box body having at least one aperture formed therein and latch means comprising a tab attached to at least one side wall of the box body. The tab is positionable in the cover aperture with a portion thereof extending beyond the cover when it is placed over the box body. The tab includes a lock flap hingedly connected to the remainder of the tap which is adapted to engage the cover to retain it on the box body when folded relative to the remainder of the tab.

Other objects and characteristics of the invention will be apparent from the following more detailed description and accompanying drawings in which:

DETAILED DESCRIPTION

Figure 1:
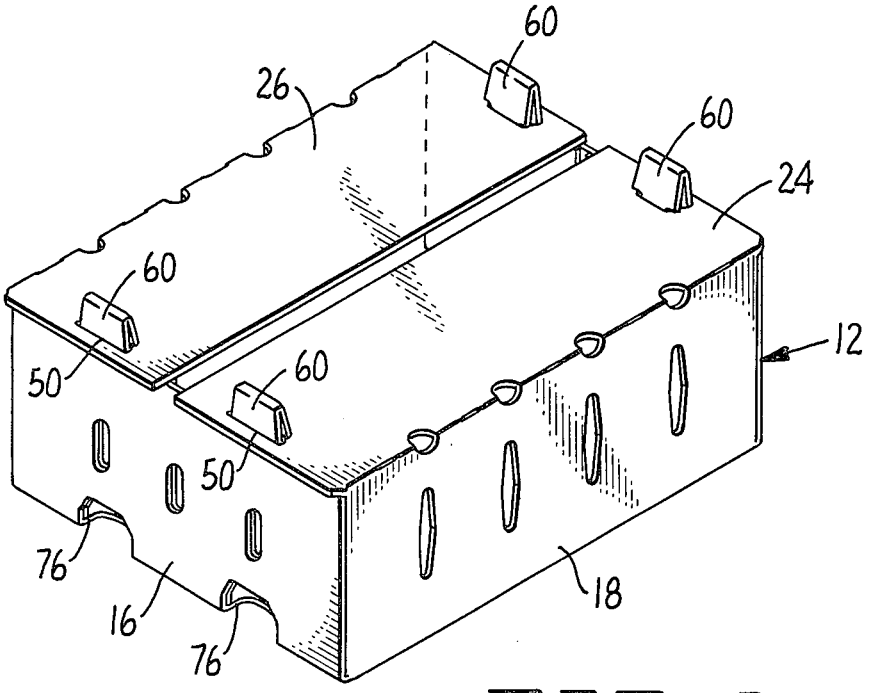
FIG. 1 is a perspective view of a closed container constructed according to the teachings of the present invention.
Figure 2:
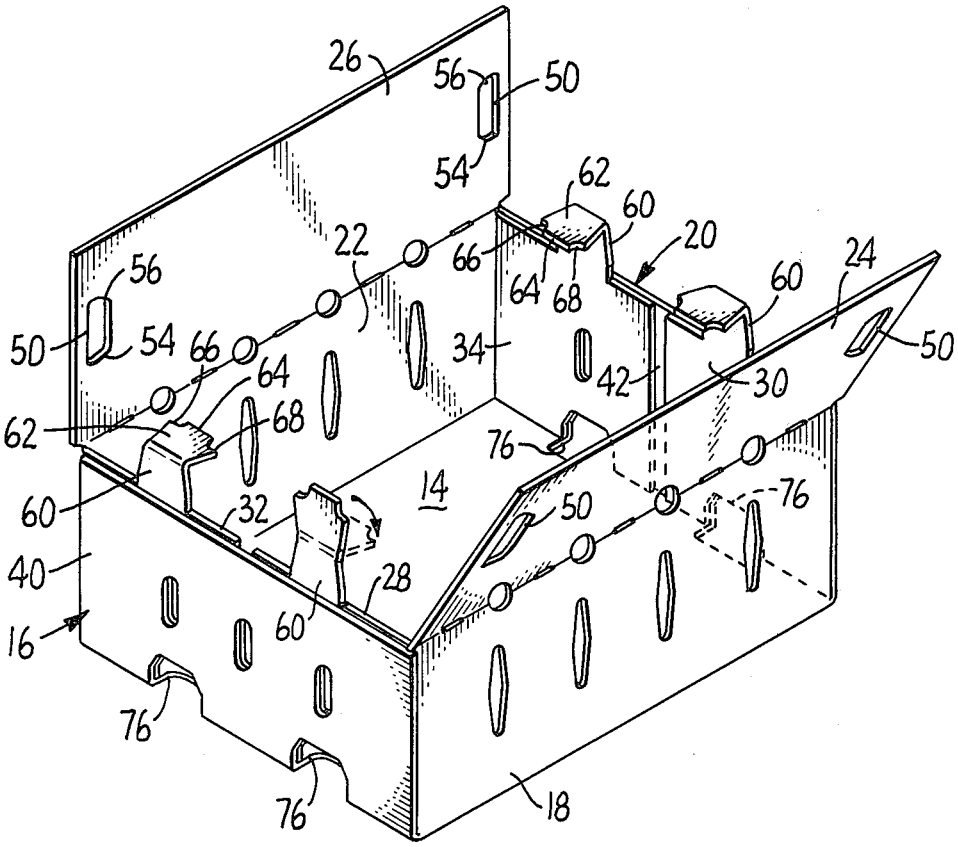
FIG. 2 is a view similar to that of FIG. 1 but showing the container in open condition.
Figure 3:
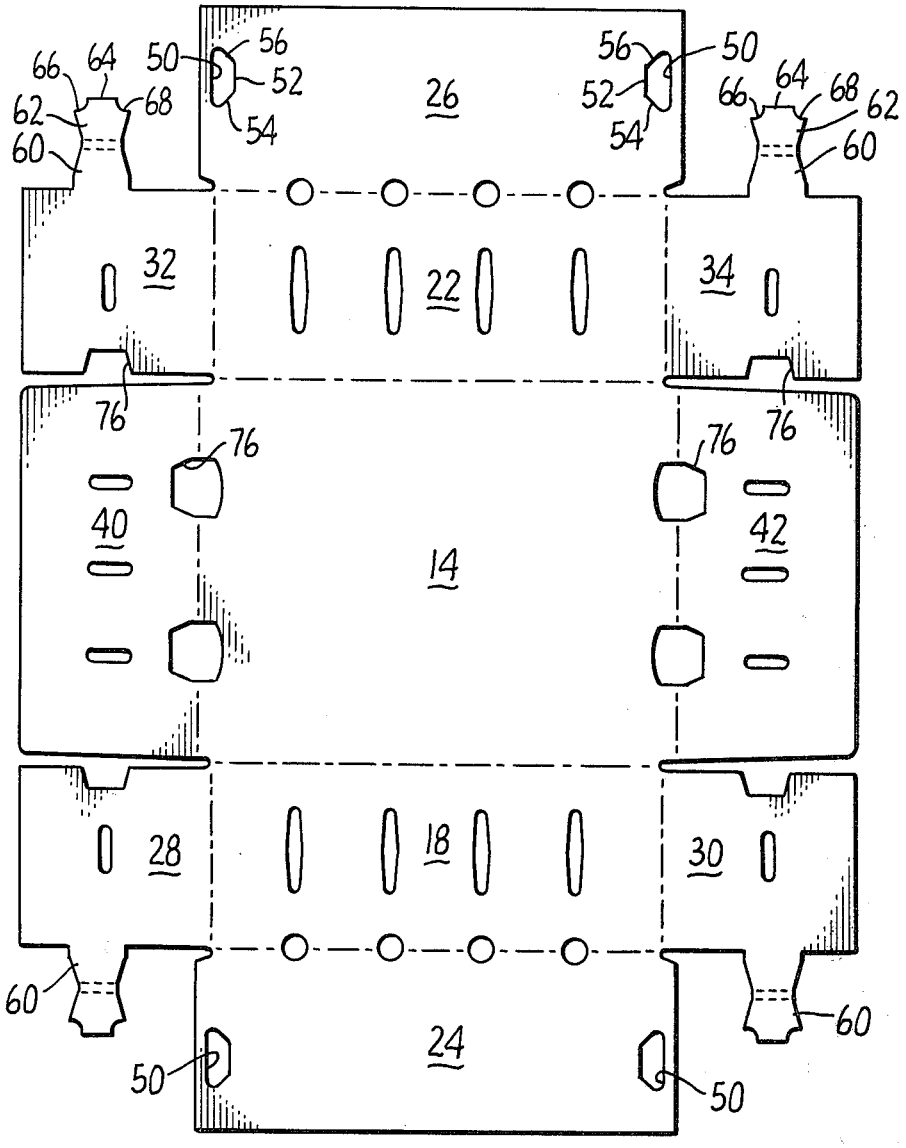
FIG. 3 is a plan view of the blank utilized in the construction of the container.
Figure 4:
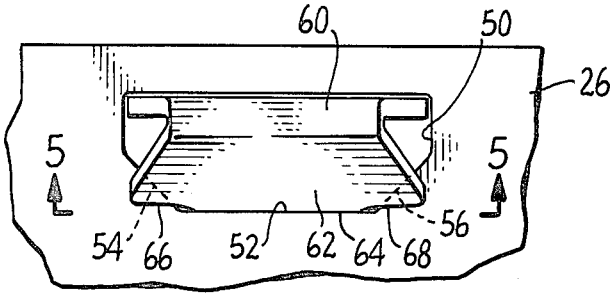
FIG. 4 is an enlarged detail plan view of the latch means of the container projecting through a cover aperture.
Figure 5:
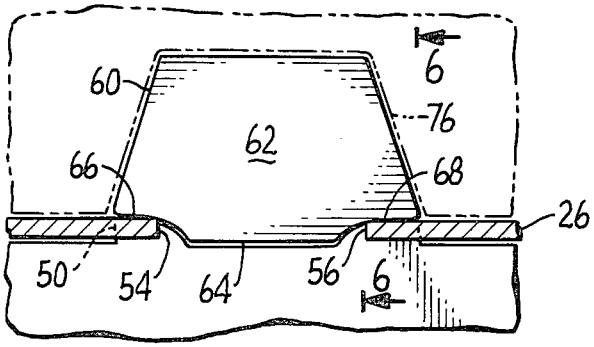
FIG. 5 is a sectional view taken along line 5—5 in FIG. 4.
Figure 6:
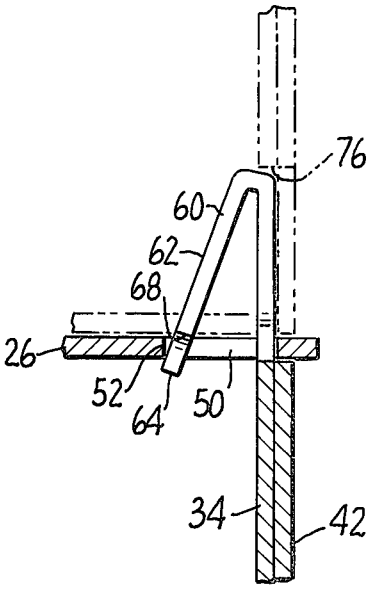
FIG. 6 is a sectional view taken along the line 6—6 in FIG. 5.

FIGS. 1, 2 and 4–8 illustrate the container of the present invention and FIG. 3 illustrates the unitary blank from which said container is assembled. The container blank may be formed of any suitable material such as fiberboard, double wall or triple wall corrugated paperboard, etc. The container concludes a box body generally indicated by reference number 12 having a bottom wall 14 and interconnecting side walls 16, 18, 20 and 22 which define a box interior. Hingedly connected to side walls 18 and 20 are cover portions 24 and 26, respectively. As may best be seen with reference to FIG. 3, which shows the blank utilized to construct the container, side walls 18 and 22 have hingedly connected to the ends thereof inner flaps 28, 30, 32 and 34, said flaps when folded over and brought into face-to-face engagement with outer end wall components 40 and 42 hingedly connected to bottom wall 14 form conjointly therewith side walls 16 and 20. The inner flaps are gluded or otherwise secured to the outer end wall components to maintain the box body in a rectangular-shaped configuration.

Apertures 50 are formed in cover portions 24 and 26 as illustrated. As will be described in detail below, latch means associated with the container is adapted to pass through apertures 50 to perform the function of securing the cover of the container in position on the box body. As may be seen with particular reference to FIG. 7 each aperture 50 has a variable width configuration including a reduced aperture area 52 partially defined by tapered surfaces 54 and 56 formed in the cover.

Integrally attached to the inner flap components of side walls 16 and 20 are latch means in the form of tabs 60. Each tab 60 includes a lock flap 62 hingedly connected to the remainder of the tab. The tab may be precreased along one or more hinge lines in the conventional manner to facilitate relative movment between the lock flap and the remainder of the tab. Each tab lock flap 62 includes a projection 64 which is of reduced width as shown to provide shoulders 66 and 68 on the lock flap.

Figure 7:
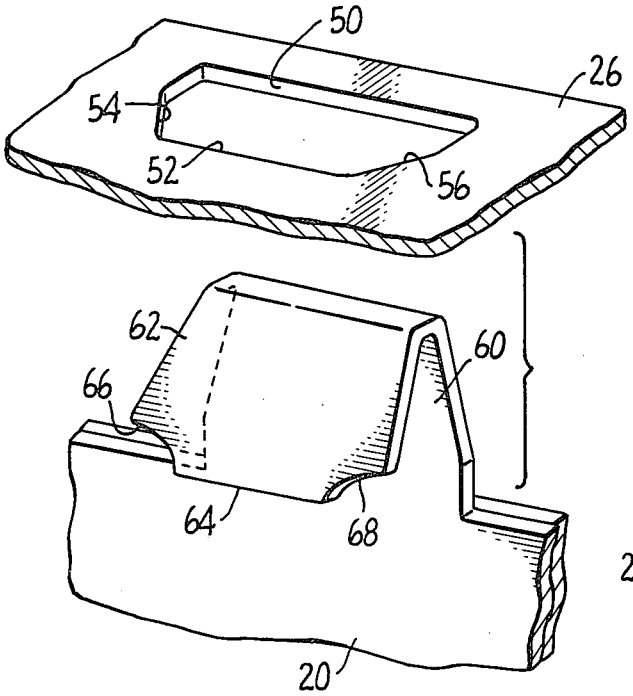
FIG. 7 is an enlarged detail exploded view showing the relative positions of the container latch means and cover just prior to engagement therebetween upon closing of the container.
Figure 8:
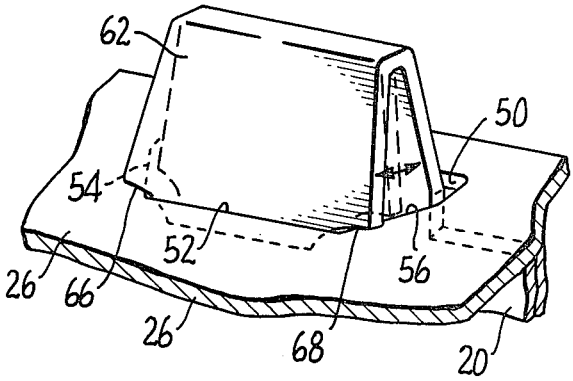
FIG. 8 is an enlarged perspective view showing details of the latch means and cover when the container is in closed condition.

When it is desired to close the container by positioning cover portions 24 and 26 over the box interior, lock flaps 62 are manipulated to bend them inwardly toward the container interior as shown in FIG. 2. Due to the inherent resilience of the corrugated paperboard or other material from which the tabs are formed, the lock flaps are inherently biased away from the remainder of the tab. That is, if the lock flap is manually squeezed together in face-to-face relationship with remainder of the tab it will tend to spring away from such face-to-face engagement when pressure is removed therefrom. After the tab lock flaps are manipulated inwardly as just described the cover portions 24 and 26 are brought into engagement with the tabs. This relationship is best illustrated in FIG. 7.

Upon continued downward movement of the cover the tab will enter aperture 50 with the tapered surfaces 54 and 56 defining aperture 50 cooperating with the tapered edges of the tap 60 to force the lock flap away from the reduced aperture area 52 so that a portion of the now generally wedge-shaped tab 60 may pass through the aperture until shoulders 66 and 68 are disposed above the cover. The inherent resiliency of the tab 60 will then cause the lock flap 62 to spring outwardly so that projection 64 is disposed within reduced aperture area 52 and the shoulders 66 and 68 are positioned above the cover to retain it in locked position. When it is desired to reopen the cover, the tap 60 is manually squeezed so that the lock flap component thereof is brought into face-to-face relationship with the remainder of the tab. This action is illustrated by the arrow in FIG. 8.

It will appreciated that tabs 60 not only perform a securing function but that they also act as stack stabilizers when containers of the present invention are stacked one upon the other. As may best be seen in FIGS. 1 and 2, stacking apertures 76 are provided at the bottom of the container. Stacking apertures 76 are in alignment with tabs 60 so that the locking tabs of containers in a stack will be accommodated by the stacking apertures 76 of a containter of identical construction stacked thereupon. Due to the essentially double wall wedge-shaped cross section of a tab performing its locking function it has considerable strength to resist stack movement as well as to resist undesired deformation during shipment and handling. Furthermore, since the upper surface of a tab portion performing its locking and stacking function is substantially continuous and unbroken it will have greater moisture resistence than prior art tabs that present their cut ends at the top thereof.

I claim:

1. A container comprising the combination of:

a box body having a bottom wall and interconnecting side walls defining a box interior;

a cover for said box body having at least one aperture formed therein; and latch means comprising a tab attached to at least one of said side walls, and tab positionable through said cover aperture with a portion thereof extending beyond said cover when said cover is positioned over said box interior and having a lock flap hingedly connected to the remainder of said tab along a hinge line formed in the tab, said lock flap including a projection and shoulder means and adapted to be folded along said hinge line to extend downwardly adjacent the remainder of said tab with said projection positionable in said cover aperture and said shoulder means engaging the upper surface of said cover to retain said cover on said box body, said lock flap being continually biased away from the remainder of said tab after being folded about the hinge line to maintain said tab projection in said aperture.

2. The container of claim 1 wherein said cover aperture has a variable width configuration including a reduced aperture area for accomodating said tab projection.

3. The container of claim 1 wherein said tab portion when in cover retaining position defines a generally wedge-shaped configuration with the upper surface of the tab portion being substantially continuous and unbroken.

4. The container of claim 2 wherein said cover aperture is partially defined by tapered surfaces formed in said cover and engageable by said tab lock flap when said cover is positioned over said box interior.

5. A container comprising the combination of:

a box body having a bottom wall and interconnecting side walls defining a box interior;

a cover for said box body having at least one aperture formed therein; and at least one tab extending upwardly from said side walls, said tab including a lock flap having a projection and shoulder means, said lock flap being resiliently hingedly connected to the remainder of said tab, said tab adapted to extend through said cover aperture when said cover is positioned over said box interior and, said lock flap being adapted to be bent downwardly adjacent the remainder of said tab with the projection resiliently positioned in the aperture and the shoulder means in engagement with said cover to retain said cover on said box and resist upward movement thereof.

* * * * *